US006102524A

United States Patent [19]

Nakano

[11] Patent Number: 6,102,524

[45] Date of Patent: Aug. 15, 2000

[54] IMAGE FORMING APPARATUS HAVING DEVELOPING POTENTIAL RELATED TO BULK DENSITY OF THE DEVELOPER

[75] Inventor: Nobuhiko Nakano, Nara, Japan

[73] Assignee: Sharp Kabushiki Kaisha, Osaka, Japan

[21] Appl. No.: 09/027,861

[22] Filed: Feb. 23, 1998

[30] Foreign Application Priority Data

Mar. 10, 1997 [JP] Japan ..... 9-055090

[51] Int. Cl.[7] ..... B41J 2/06

[52] U.S. Cl. ..... 347/55

[58] Field of Search ..... 347/55, 131, 141; 399/55, 271, 291, 293, 295, 181, 175, 229

[56] References Cited

U.S. PATENT DOCUMENTS 5,479,195 12/1995 Takagi ..... 347/55
5,774,153 6/1998 Kuehnle et al. .

FOREIGN PATENT DOCUMENTS 0 617 335 A2 9/1994 European Pat. Off. .
0 720 072 A2 7/1996 European Pat. Off. .
7-47708 2/1995 Japan .

OTHER PUBLICATIONS

Patent Abstracts of Japan, vol. 095, No. 005, Jun. 30, 1995, and JP 07 047708 A (1995).

*Primary Examiner*—John Barlow
*Assistant Examiner*—Raquel Yvette Gordon
*Attorney, Agent, or Firm*—David G. Conlin; George W. Neuner; Dike Bronstein Roberts & Cushman, LLP

[57] ABSTRACT

In a system having a developer support, an opposing member arranged facing the developer support, the process conditions including the property of the developer are adapted to satisfy the following relation:

$$\Delta V/d = E > 5.5 - 10 \times \Delta AD,$$

where ΔV is the potential difference between the developer support and opposing member, d is the distance between the developer support and opposing member, AD is the bulk density of the developer, and E is the electric field strength which is calculated from the potential difference ΔV and the distance d between the developer support and opposing member.

9 Claims, 8 Drawing Sheets

FIG. 2

| Toner No. | Particle Size | Added amount of silica | Coat ratio | Added amount of CCA | CCA type | Heat treatment as post-processing | Bulk density | Electric field at ID-1.3 |
|---|---|---|---|---|---|---|---|---|
| | | Relative value | Relative value | Relative value | | Done/Undone | (g/cc) | (kV/mm) |
| | | | | | | | | |
| 1 | 11.22 | 1 | 153 | 1 | A | Done | 0.430 | 1.90 |
| 2 | 8.88 | 1 | 121 | 1 | A | Done | 0.380 | 2.44 |
| 3 | 13.04 | 1 | 178 | 1 | A | Done | 0.435 | 2.31 |
| 4 | 8.86 | 1.23 | 149 | 1 | A | Done | 0.397 | 2.12 |
| 5 | 12.99 | 0.85 | 150 | 1 | A | Done | 0.422 | 1.88 |
| 6 | 11.20 | 1.54 | 237 | 1 | A | Done | 0.460 | 1.88 |
| 7 | 11.15 | 0.77 | 117 | 1 | A | Done | 0.416 | 2.42 |
| 8 | 11.16 | 0.46 | 70 | 1 | A | Done | 0.378 | 2.83 |
| 9 | 11.52 | 1 | 157 | 0.5 | A | Done | 0.415 | 1.98 |
| 10 | 10.65 | 1 | 145 | 0.75 | A | Done | 0.416 | 2.38 |
| 11 | 11.13 | 1 | 152 | 1.5 | A | Done | 0.422 | 2.40 |
| 12 | 10.58 | 1 | 144 | 1 | B | Done | 0.388 | 2.20 |
| 13 | 11.62 | 1 | 159 | 1 | C | Done | 0.425 | 2.84 |
| 14 | 10.93 | 1 | 149 | 1 | A | Undone | 0.453 | 1.77 |
| 15 | 8.89 | 1 | 121 | 1 | A | Undone | 0.415 | 1.97 |
| 16 | 13.01 | 1 | 178 | 1 | A | Undone | 0.464 | 1.36 |
| 17 | 8.89 | 1.23 | 150 | 1 | A | Undone | 0.41 | 1.85 |
| 18 | 12.97 | 0.86 | 149 | 1 | A | Undone | 0.459 | 1.38 |
| 19 | 11.12 | 1.54 | 235 | 1 | A | Undone | 0.437 | 1.46 |
| 20 | 11.05 | 0.77 | 116 | 1 | A | Undone | 0.444 | 1.87 |
| 21 | 10.90 | 0.46 | 68 | 1 | A | Undone | 0.417 | 2.25 |
| 22 | 10.93 | 0.23 | 34 | 1 | A | Undone | 0.37 | 2.92 |
| 23 | 11.49 | 1 | 157 | 0.5 | A | Undone | 0.451 | 1.72 |
| 24 | 10.68 | 1 | 146 | 0.75 | A | Undone | 0.437 | 1.60 |
| 25 | 11.13 | 1 | 152 | 1.5 | A | Undone | 0.451 | 1.46 |
| 26 | 10.68 | 1 | 146 | 1 | B | Undone | 0.428 | 1.43 |
| 27 | 11.64 | 1 | 159 | 1 | C | Undone | 0.459 | 1.49 |

IMAGE FORMING APPARATUS HAVING DEVELOPING POTENTIAL RELATED TO BULK DENSITY OF THE DEVELOPER

BACKGROUND OF THE INVENTION (1) Field of the Invention

The present invention relates to an image forming apparatus such as a digital copier, printer unit for a facsimile machine, digital printer, plotter etc., and more particularly relates to an image forming apparatus in which an image is formed on a recording medium by causing the developer to jump thereto.

(2) Description of the Prior Art

There have been known image forming apparatuses which, in accordance with an image signal, form a visual image on a recording medium such as paper etc.

Japanese Patent Application Laid-Open Hei 7 No. 47,708, for example, discloses an image forming apparatus wherein charged particles are placed in an electric field so that they will jump by electric force to adhere to the recording medium whilst the potential to be applied to the control electrode having a number of passage holes located in the jumping passage is being varied, to thereby form a latent image on the recording medium, and during this, dust-sized particles are removed from the charged particles to be transferred for development.

More specifically, in this prior art technique, the charged particles held on a grading roller are caused to jump to the toner support roller by the reactive force arising during elastic collision of the charged particles against the blade, so that only the charged particles from which the dust-sized component has been removed will be transferred to the toner support roller. The thus selected toner on the toner support roller is controlled and made to jump by the control electrode.

The above prior art technique, however, did not take into account the bulk density of the developer. Therefore, this method includes the problem that the printed result fluctuates due to the variations in bulk density of the developer.

As a result, the current situation is that open selection of the developer is not possible from a point of view of cost performance and/or user's taste when the developer is used for an image forming apparatus such as a digital copier, facsimile machine, digital printer, plotter etc.

It is a critical and important problem that the processing of an image be controlled appropriately with regard not only to the distribution of size of the developer particles but also to bulk density of the developer, in order to form satisfactory images regardless of variations in bulk density of the developer.

SUMMARY OF THE INVENTION

In view of solving the above problems, it is an object of the present invention to provide an image forming apparatus which, even when a variety of developers having different bulk densities are used, can effectively produce good images in response to the bulk density of the developer.

In order to achieve the above object, the present invention is configured as follows:

In accordance with the first aspect of the invention, an image forming apparatus includes:

a supporting member at least supporting a color of developer; and an opposing member disposed facing the supporting member, wherein d>>dt, where dt(mm) is the developer layer thickness and d(mm) is the gap between the opposing member and the supporting member, and is characterized in that an arbitrary developer having a bulk density AD(g/cc) is used wherein the bulk density AD and the potential difference Δ V between the supporting member and opposing member satisfy the following relation:

$$\Delta V/d=E>5.5-10\times AD,$$

where the electric field strength represents E(V/mm).

In accordance with the second aspect of the invention, an image forming apparatus includes:

a supplying means having a supporting member which supports at least a color of developer;

an opposing electrode disposed facing the supporting member; and a control electrode having a plurality of passage holes with electrodes for providing the jumping passage of the developer transferring from the supporting member and disposed between the opposing electrode and supporting member, wherein an image is formed on a recording medium which is conveyed between the control electrode and opposing electrode whilst the voltage to be applied to the control electrode is controlled in accordance with image data, and is characterized in that an arbitrary developer having a bulk density AD (g/cc) which satisfies the following relation is used:

$$E0>2.5-4\times AD$$

where E0 (V/mm) is the electric field strength determined by the combination of the electric field strength based on the potential difference and distance between the opposing electrode and the supporting member and the electric field strength based on the potential difference and distance between the control electrode and supporting member.

In accordance with the third aspect of the invention, the image forming apparatus having the above second configuration, is characterized in the supplying means comprises a plurality of supporting members which supports different colors of developers.

BRIEF DESCRIPTION OF THE DRAWINGS

FIG. 2 is a table showing the relationship between the bulk density and electric field strength for each of the developers used in first embodiment;

DESCRIPTION OF THE PREFERRED EMBODIMENTS

The embodiments of the invention will hereinafter be described in detail with reference to the accompanying drawings. In the following embodiments, description will be made of a case where an image forming apparatus having a configuration for negatively charged toner is applied to the present invention.

Figure 1:
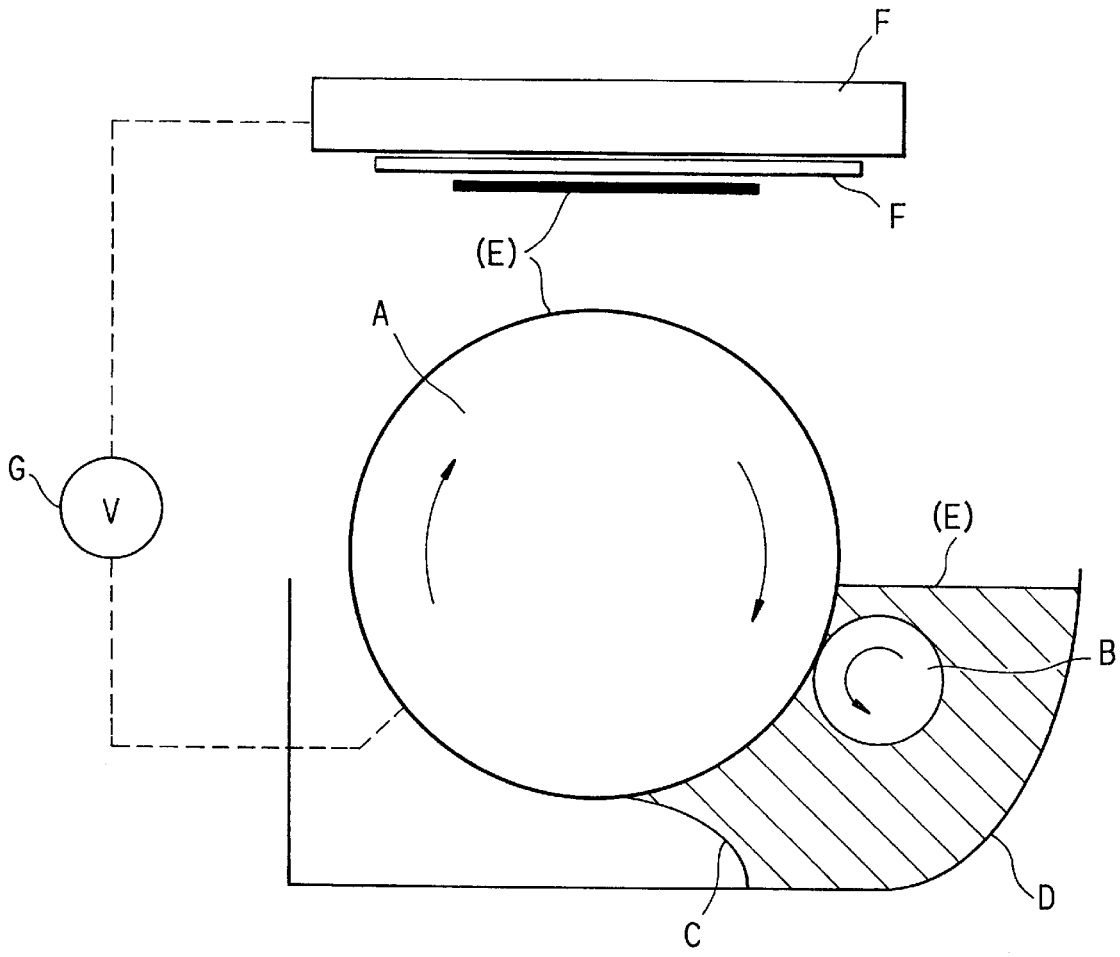
FIG. 1 is an illustrative view showing the concept of an image forming apparatus used in the first embodiment.

FIG. 1 is an illustrative view showing the concept of an image forming apparatus to be used in the mode of the first embodiment.

Developer E is tribo-electrified negatively by its friction with a developer support A, developer supplying roller B and developer regulating blade C., and is regulated by means of developer regulating blade C into the form of a layer on developer support A.

The charged developer E supported on developer support A will be caused to jump toward an opposing member F by the electric field generated based on the potential difference and distance between developer support A and opposing member F. Here, it should be noted that the potential of opposing electrode F relative to developer support A is positive.

In this mode of embodiment, with a sheet of paper set on opposing member F, developer E was caused to jump toward the paper whilst the strength of the electric field generated based on the potential difference and distance between developer support A and opposing member F was arbitrarily varied. Then, the developer E thus transferred to the recording paper was fixed by heat roll fixing, and the resulting image for each different developer was measured for its density. In this way, the density of the transferred developer with respect to the strength of the electric field was measured. In this case, the strength of the electric field under which each of different developers E could provide an image density of 1.3 was evaluated since a typically needed image density is equal to 1.3 or higher.

As for the evaluation, the distance between developer support A and opposing member F was set at 1 mm which was large enough compared to 50 $\mu$m to 100 $\mu$m, the thickness of the layer of developer E formed on developer support A, while the potential difference between developer support A and opposing electrode F was varied from 250 V to 3 kV. Under these conditions, the image density with respect to the electric field was measured after developer E had been caused to jump.

For a developer E to be evaluated, St/Ac resin, carbon black, a negative-charge type charge controlling agent and a separation agent, were pre-mixed, and melted and kneaded and then crushed whilst being classified so as to produce a variety of developers with respect to particle size. The thus produced developer was post-processed by adding silica as a fluidizer, and then was heated as appropriate for surface treatment.

Twenty seven types of developers E, each different from the others in the bulk density AD, were prepared by varying the parameters such as particle size, the amount of fluidizer, the amount and type of a charge controlling agent, presence or absence of heat treatment as post-processing. The bulk density AD of developer E was measured by a measuring device designated by JIS-K5101 and the image density was measured by a reflection type densitometer (X-rite 310).

For these 27 types of developers, having different bulk densities, electric field strengths E for obtaining a necessary density of 1.3 (to be referred to as 'ID=1.3') were empirically determined, and it was found that it would be possible to use any developer 5 having an arbitrary bulk density if an electric field strength E, generated by potential difference $\Delta V$ and distance d between developer support A and opposing member F, satisfied the relation:

$$\Delta V/d(ID=1.3)=E(ID=1.3)>5.5-10\times AD.$$

FIG. 2 is a table showing each of the developers used in this embodiment and their bulk densities and electric fields (ID=1.3), specifically, showing bulk densities and electric fields for various toners, i.e., developers, different in particle size, the added amount of silica, the added amount of CCA, the CCA type, and either presence or absence of heat treatment as post-processing.

Figure 3:
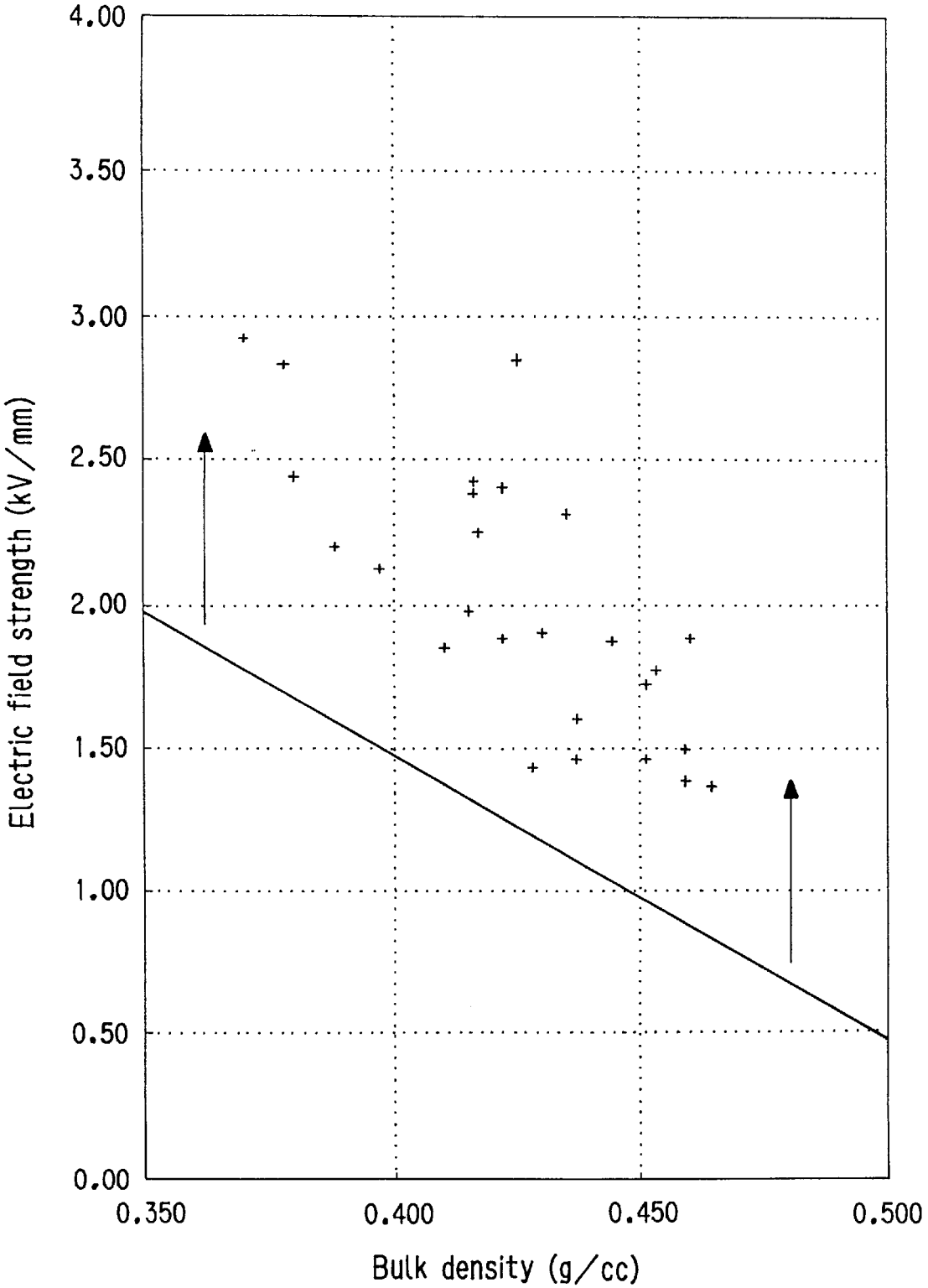
FIG. 3 is a plot showing the relationship between the bulk density AD and the required electric field strength for each of the developers shown in FIG. 2.

FIG. 3 is a plot showing the relationship between bulk density AD of each developer shown in FIG. 2 and the required field strength. As seen from this figure, the bulk density AD of developers and the electric field strength at ID=1.3 have an inverse proportional relation, which means that if the bulk density AD increases then the electric field decreases.

It should be noted that electric field strengths at ID=1.3 are always greater than (5.5–10×AD).

This means that the value of bulk density AD may be set arbitrarily, but it is preferred that the bulk density AD be equal to or greater than 0.35 (g/cc) and equal to or lower than 0.50 (g/cc), for production and application requirements.

As has been detailed herein before, in this embodiment, when a developer support A and an opposing member F disposed facing developer support A are provided, and the potential difference between developer support A and opposing member F is represented as $\Delta V$, the distance between developer support A and opposing member F as d, the electric field strength as E, and the bulk density as AD, the electric field strength calculated from the bulk density AD of a developer, the potential difference $\Delta V$ and distance d between developer support A and opposing member F were set so as to satisfy the following relation:

$$\Delta V/d=E>5.5-10\times AD,$$

it is possible to produce good images regardless of the bulk density of a toner.

Thus, the first embodiment has been described. Next, the second embodiment will be described.

Figure 4:
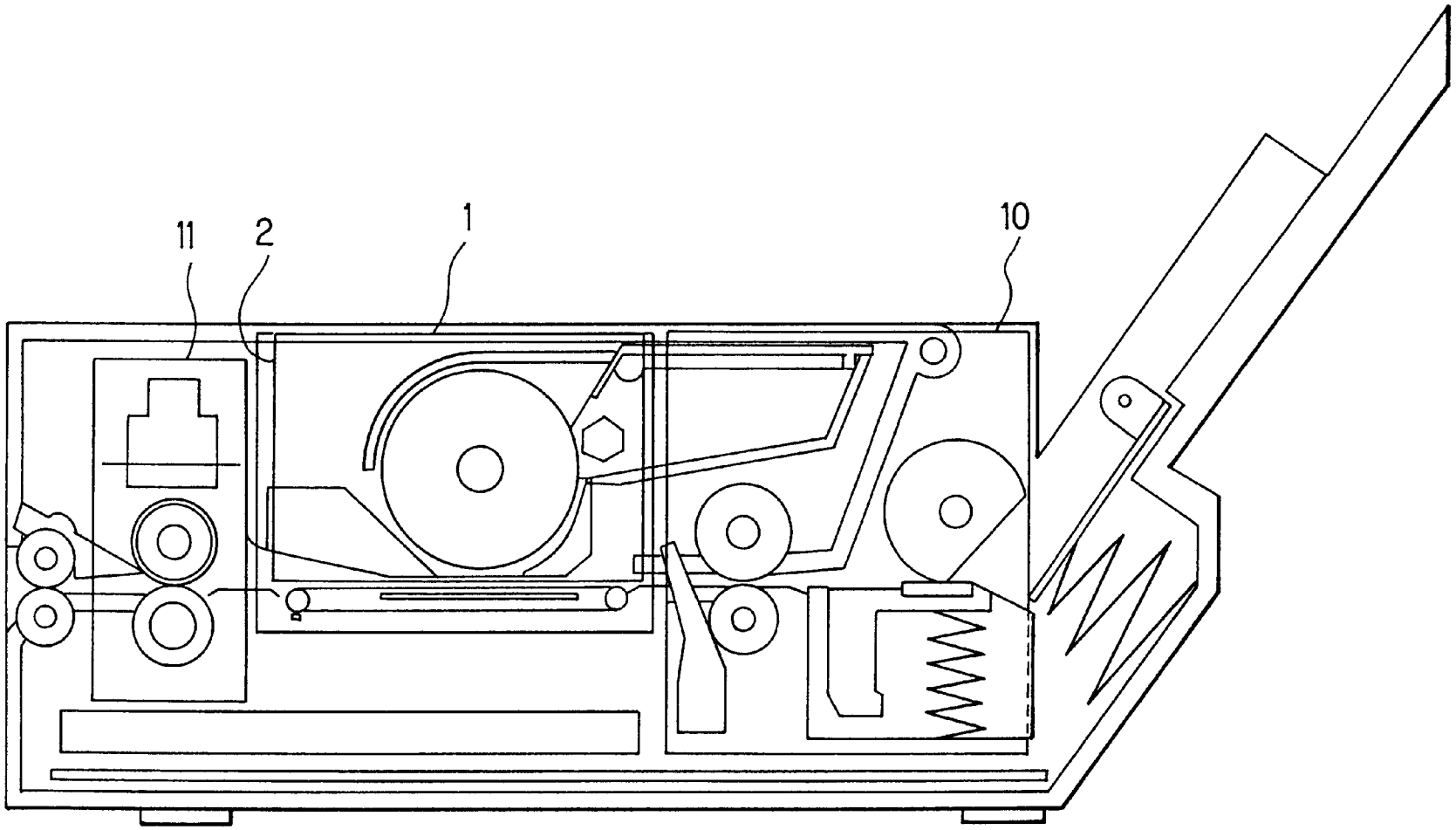
FIG. 4 is a sectional view showing an image forming apparatus used in the second embodiment.

FIG. 4 is a sectional view showing an image forming apparatus used in the second embodiment.

As shown in FIG. 4, this image forming apparatus has an image forming unit 1 which creates a visual image in accordance with an image signal, onto a sheet of paper as the recording medium with toner as the developer. This image forming unit 1 includes a toner supplying section 2 and a printing section.

More specifically, in this image forming unit 1, the toner is made to jump and adhere onto the paper whilst the jumping of the toner is controlled based on the image forming signal so as to directly create an image on the paper.

This image forming apparatus includes: a paper feeder 10 which picks up sheets for images to be formed thereon, from a sheet cassette; and a fixing unit 11 for fixing the toner image formed on the paper through image forming unit 1, onto the paper.

Next, a more illustrative configuration of the image forming apparatus will be explained.

Figure 5:
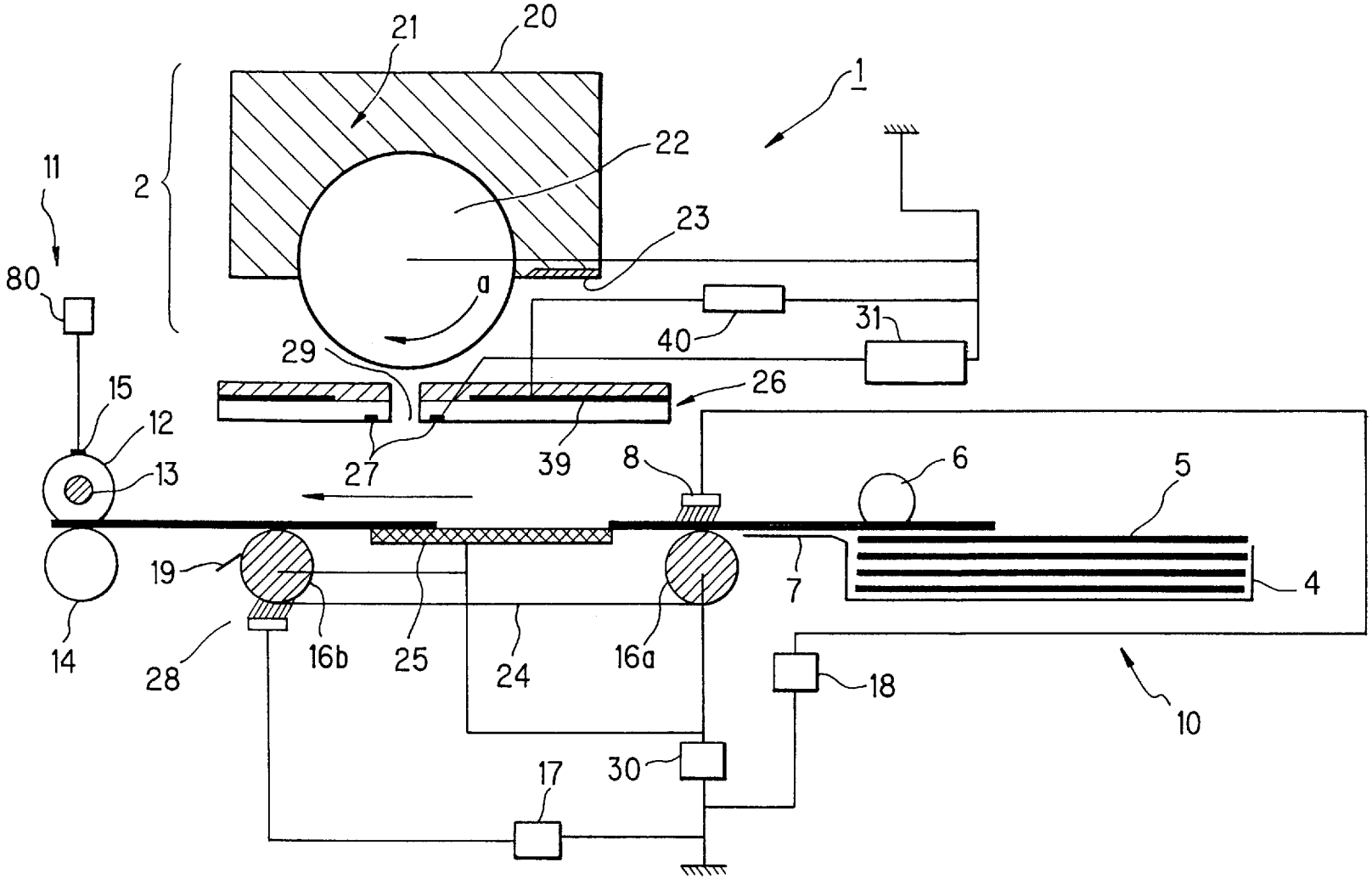
FIG. 5 is a diagram showing the configuration of an image forming apparatus used in the second embodiment.

FIG. 5 is a diagram showing the configuration of an image forming apparatus used in the second embodiment.

As shown in FIG. 5, this image forming apparatus has an image forming unit 1 which is composed of a toner supplying section 2 and a printing section 3. Image forming unit 1 creates a visual image in accordance with an image signal, onto a sheet of paper as the recording medium with toner as the developer.

A paper feeder 10 is provided on the input side of this image forming apparatus 1 to which the paper is fed. Paper feeder 10 is composed of a paper cassette 4 for storing paper 5 as the recording medium, a pickup roller 6 for delivering paper 5 from paper cassette 4, and a paper guide 7 for guiding fed paper 5.

Paper feeder 10 further has a detecting sensor for detecting the feed of paper 5. Pickup roller 6 is rotationally driven by an unillustrated driving means.

Provided on the output side of image forming unit 1 from which the paper is output, is a fixing unit 11 for heating and pressing the toner image which was formed on paper 5 at image forming unit 1, to fix it onto paper 5.

Fixing unit 11 is composed of a heat roller 12 made up of an aluminum pipe of 2 mm thick, a heater 13 of a halogen lamp, a pressing roller 14 made of silicone resin, a temperature sensor 15 for measuring the surface temperature of heat roller 12, a temperature controller circuit 80, and an unillustrated sensor for detecting the discharge of paper 5.

Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts.

Temperature controller circuit 80 is controlled by a main controller and performs the on/off operation of heater 13 based on the measurement of temperature sensor 15, thus maintaining the surface temperature of heater roller 12 at, for example, 150° C.

The materials of heat roller 12, heater 13, pressing roller 14, etc., as well as the surface temperature of heat roller 12, are not specifically limited. Further, fixing may be performed using a fixing configuration in which paper 5 is either heated or pressed only to fix the toner image.

Further, although it is not shown in the drawing, a paper discharge roller for discharging paper 5 processed through fixing unit 11 onto a paper output tray and a paper output tray for holding paper 5 thus discharged are provided on the paper output side of fixing unit 11. Heat roller 12, pressing roller 14 and paper discharge roller are rotated by an unillustrated driving means.

Toner supplying section 2 in image forming unit 1 is composed of a toner storage tank 20 for storing toner 21 as the developer, a toner support 22 of a cylindrical sleeve for supporting toner 21 and a doctor blade 23 which is provided inside toner storage tank 20 to electrify toner 21 and regulate the thickness of the toner layer carried on the peripheral surface of toner support 22.

Doctor blade 23 is of an elastic material and arranged on the upstream side of the printing section with respect to the rotational direction of toner support 22 so that it will come in contract with the outer peripheral surface of toner support 22. Accordingly, toner 21 is electrified with charge by friction with doctor blade 23. The spacing between doctor blade 23 and toner support 22 is not specifically limited.

Toner support 22 is rotationally driven by an unillustrated driving means in the direction indicated by arrow a in the figure, with its surface speed set at 80 mm/sec, for example. Toner support 22 is grounded and is configured so that it can carry toner 21 on its peripheral surface. The rotating speed of toner support 22 is not particularly limited.

Printing section 3 in image forming unit 1 includes: an opposing electrode 25 which is made up of an aluminum sheet of, for example, 1 mm thick and faces the peripheral surface of toner support 22; a high-voltage power source 30 for supplying a high voltage to opposing electrode 25; a control electrode 26 provided between opposing electrode 25 and toner support 22; a charge erasing brush 28; a charge erasing power source 17 for applying a charge erasing voltage to charge erasing brush 28; a charging brush 8 for charging sheet 5; a charger power source 18 for supplying a charger voltage to charging brush 8; a dielectric belt 24; support rollers 16*a* and 16*b* for supporting dielectric belt 24; and a cleaner blade 19.

Opposing electrode 25 is arranged e.g., 1.0 mm apart from the peripheral surface of toner support 22. Dielectric belt 24 is made of PVDF as a base material, and is 75 $\mu$m thick with a volume resistivity of $10^{10}$ Ω.cm. Dielectric belt 24 is rotated by an unillustrated driving means in the direction of the arrow shown in the drawing, at a surface speed of 30 mm/sec.

Applied to opposing electrode 25 is a high voltage, e.g., 2.3 kV from high voltage power source (controlling means) 30. This high voltage supplied from high voltage power source 30 generates an electric field between opposing electrode 25 and toner support 22, for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26. Charge erasing brush 28 has an erasing potential of 2.5 kV applied from charge erasing power source 17 so as to eliminate unnecessary charges on the surface of dielectric belt 24.

If some toner 21 adhered to the surface of dielectric belt 24 due to a contingency such as paper jam, etc., cleaning blade 19 removes this toner 21 to prevent staining by toner 21 on the paper underside.

The material of opposing electrode 25, the distance between opposing electrode 25 and toner support 22, as well as the rotational speed of opposing electrode 25 and the voltage to be applied thereto, all are not particularly limited.

Although unillustrated, this image forming apparatus includes: a main controller for controlling the whole image forming apparatus; an image processor for converting the obtained image data into a format of image data to be printed; an image memory for storage of the converted image data; and an image forming control unit for converting the image data obtained from the image processor into the image data to be given to control electrode 26.

Control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25.

The electric field formed around the surface of toner support 22 varies depending on the potential being applied to control electrode 26, so that the jumping of toner 21 from toner support 22 to opposing electrode 25 is controlled.

Control electrode 26 is arranged so that its distance from the peripheral surface of toner support 22 is set at 100 $\mu$m, for example, and is secured by means of an unillustrated supporter member.

Figure 6:
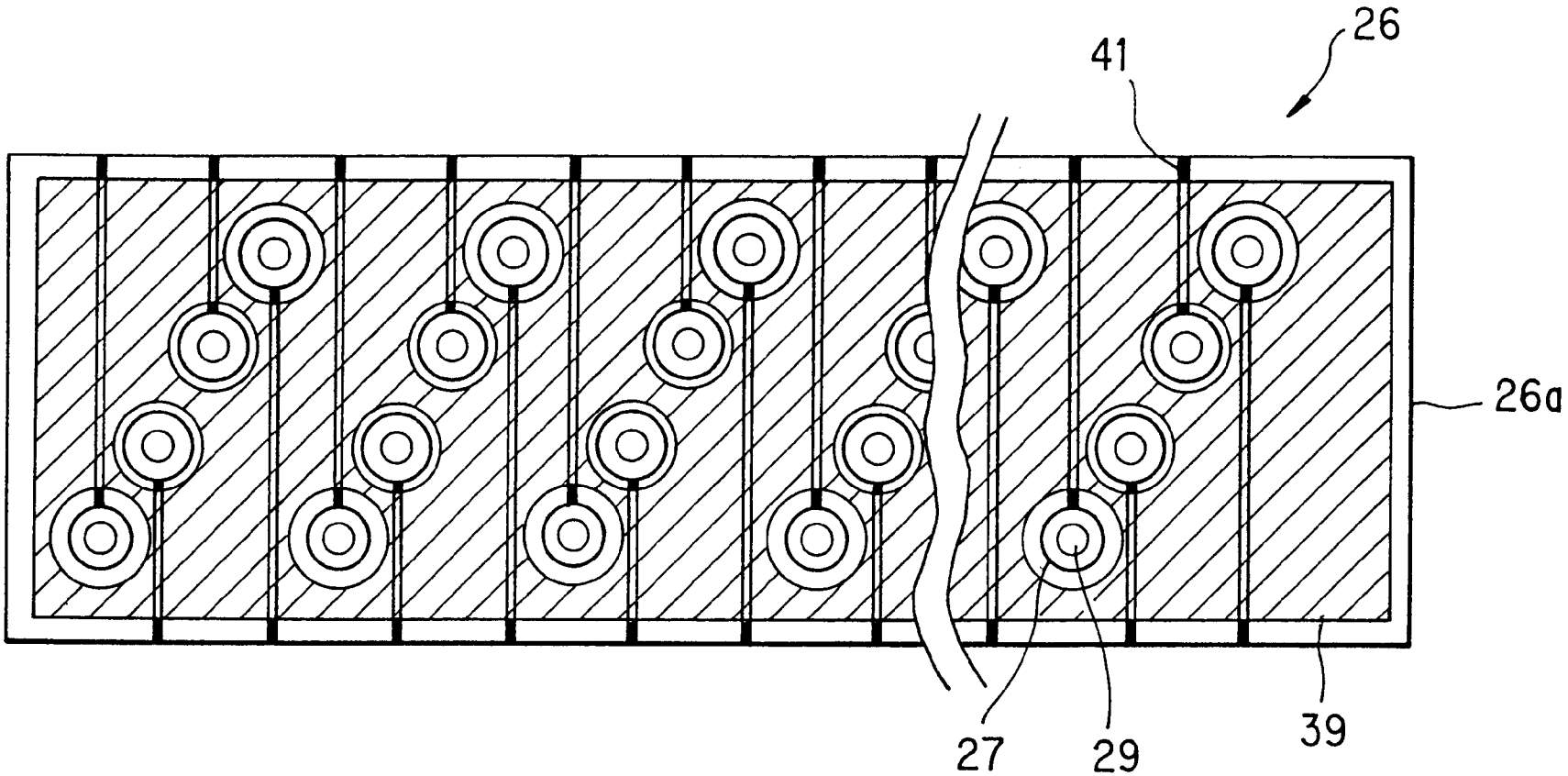
FIG. 6 is a diagram showing the planar structure of the control electrode shown in FIG. 5.
Figure 7:
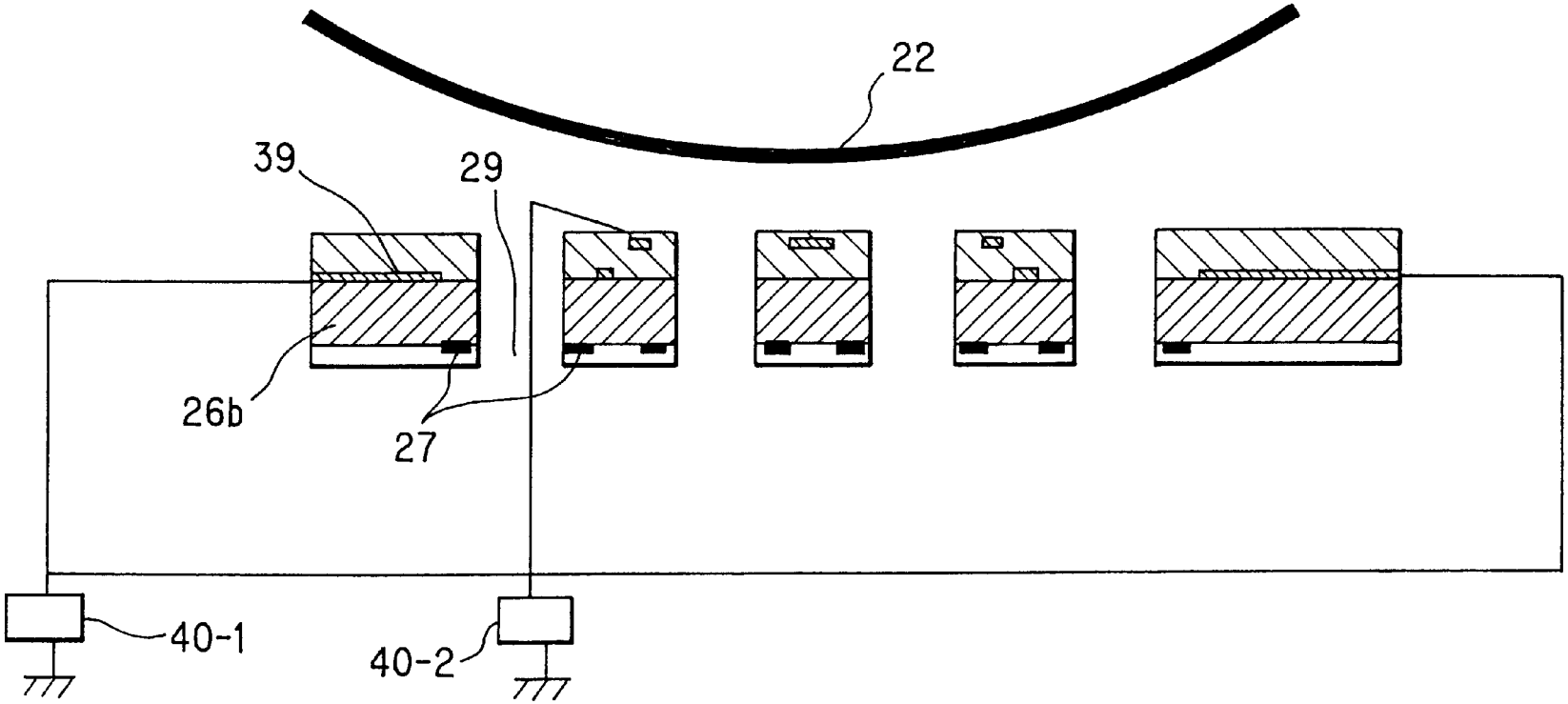
FIG. 7 is a diagram showing the sectional structure of the control electrode shown in FIG. 5.

FIGS. 6 and 7 are diagrams showing the planar and sectional structures of control electrode 26 shown in FIG. 5. As shown in these figures, control electrode 26 is composed of an insulative board 26*a*, a high voltage driver (not shown), annular conductors independent of one another, i.e., annular electrodes 27.

Board 26*a* is made from a polyimide resin, for example, with a thickness of 25 $\mu$m, further has holes forming gates 29, to be mentioned later, formed therein.

Annular electrodes 27 are formed of copper foil of e.g., 18 $\mu$m thick and are arranged around the holes, in a predetermined layout on the side of board 26*a* which faces opposing electrode 25.

Each opening of the hole is formed with a diameter of 160 μm, for example, forming a passage (to be referred to as gate 29 hereinbelow) for toner 21 to jump from toner support 22 to opposing electrode 25. Also, the distance between control electrode 26 and toner support 22 is not particularly limited.

Each annular electrode 27 has an opening of 200 μm in diameter. Provided on the side closer to toner support 22 with respect to board 26*a* is a shield 39 which is also made up of copper foil of 18 μm thick and has openings with the aftermentioned diameter at the positions corresponding to gates 29. Here, the size of gates 29 and the materials and thickness of board 26*a* and annular electrodes 27 are not particularly limited.

The above gates 29 or the holes in annular electrodes 27 are formed at, for example, 2,560 sites. Each annular electrode 27 is electrically connected to a control power source 31 via feeder line 41 and a high voltage driver (not shown). The number of annular electrodes 27 is not particular limited.

The surface of shield electrode 39, the surface of annular electrodes 27 and the surface of feeder lines 41 are covered with an unillustrated insulative layer of 30 μm thick, which ensures insulation between annular electrodes 27, insulation between feeder lines 41, insulation between annular electrodes 27 and feeder lines 41 which are not connected with each other, insulation from toner support 22 and insulation from opposing electrode 25. The material and thickness of the insulative layer are not particularly limited.

Supplied to annular electrodes 27 of control electrode 26 are voltages or pulses in accordance with the image signal from control power source 31. Specifically, when toner 21 carried on toner support 22 is made to pass toward opposing electrode 25, control power source 31 applies a voltage, e.g., 200 V to annular electrodes 27, whereas it applies a voltage, e.g., −150 V to annular electrode 27 when the toner is blocked from passing.

Supplied to shield electrode 39 provided for control electrode 26 is a shield voltage of −20 V from a shield voltage power source 40 so as to prevent toner 21 from adhering to control electrode 26.

In this way, whilst the potential to be imparted to control electrode 26 is controlled in accordance with the image signal, a sheet of paper 5 is fed over opposing electrode 25 on the side thereof facing toner support 22. Thus, a toner image is formed on the surface of paper 5 in accordance with the image signal. Here, control power source 31 is controlled by a control electrode controlling signal transmitted from an unillustrated image forming control unit.

The specific configuration of the image forming apparatus used in the second embodiment has been illustrated in the foregoing description.

Next, a specific processing operation of the above image forming apparatus will be described with reference to FIG. 5. The following description will be the case where the invention is applied to the printing unit of a digital copier.

First, when the user operates the copy start key (not shown) with an original to be copied set on the image pickup section, the main controller, in response to this input, starts the image forming operation.

More specifically, the image pickup section reads the image from the original. The image data thus taken is processed in the image processing section to be stored into the image memory. This image data stored in the image memory is then transferred to the image forming control unit, where the input image data is converted into a control electrode controlling signal to be applied to control electrode 26.

When the image forming control unit acquires a predetermined amount of the control electrode controlling signal, an unillustrated drive means operates to rotate pickup roller 6 thereby sending out a sheet of paper 5 from paper cassette 4 toward image forming unit 1, and the paper sensor detects the state of the paper being correctly fed. The aforementioned predetermined amount of the control electrode controlling signal differs depending upon the configuration etc. of the image forming apparatus.

The paper 5 thus sent out by pickup roller 6 is conveyed between charging brush 8 to which a charging potential of 1.2 kV is applied from charger power source 18 and support member 16 to which a voltage equal to the potential of opposing electrode 25 is applied from high-voltage power source 30.

Charge is supplied to paper 5 due to the potential difference between charging brush 8 and support member 16*a*, so that it is conveyed, whilst being electrostatically attracted to dielectric belt 24, to the position where the paper faces toner support 22.

Then, the image forming unit provides the control electrode controlling signal to control power source 31 at a time synchronized with the feeding of paper 5 to printing section 3 by means of charging brush 8. Control power source 31, based on this control electrode controlling signal, controls the high voltage to be applied to each of annular electrodes 27 of control electrode 26.

Illustratively, control power source 31 applies a voltage, either 200 V or −150 V as designated, to annular electrodes 27, so as to control the electric field near control electrode 26. Thus, at each of gates 29 of control electrode 26, prohibition or release of jumping of toner 21 from toner support 22 toward opposing electrode 25 is selected in accordance with the image data.

In this way, the toner image corresponding to the image signal is formed on paper 5 which is moving toward the paper output side at a rate of 30 mm/sec as dielectric belt 24 over the surface of opposing electrode 25 moves.

Paper 5 with a toner image formed thereon is separated from dielectric belt 24 due to the curvature of support member 16*b* as it is conveyed thereby and is fed to fixing unit 11, where the toner image is fixed to paper 5.

Paper 5 with a toner image fixed thereon is discharged by the discharge roller onto the paper output tray. When the paper discharge sensor has detected the fact that the paper has been properly discharged, the main controller judges from this detection that the printing operation has been properly complete.

By the image forming operation described above, a good image can be created on paper 5.

Since this image forming apparatus directly forms the image on paper 5, it is no longer necessary to use a developer medium such as photoreceptor, dielectric drum, etc., which were used in conventional image forming apparatuses. As a result, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus In size and cost.

The description made above is the case where the invention is applied to the printing portion of a digital copier, but the invention may be applied in a similar manner to the printer portion for an output terminal of a computer.

As stated already, toner support 22 is grounded while a high voltage of 2.3 kV is applied between opposing electrode 25 and support member 16*a,* and charging brush 8 is applied with a high voltage of 1.2 kV. As a result, negative charge is supplied to the surface of paper 5 fed between charging brush 8 and dielectric belt 24, by the potential difference between charging brush 8 and support member 16*a*.

As supplied with negative charge, paper 5 is attracted to dielectric belt 24 by the static electric force of the charge and is conveyed to directly below gates 29 as dielectric belt 24 moves. The charge on the surface of dielectric belt 24 dissipates with time, hence, when it reaches directly below gates 29 the paper will have a surf ace potential of 2 kV due to the equilibrium with the potential of opposing electrode 25.

In this condition, in order for toner 21 carried on toner support 22 to pass toward opposing electrode 25, control power source 31 is caused to apply a voltage of 200 V to annular electrodes 27 of control electrode 26. When toner 21 needs to be stopped passing through gates 29, a voltage of −150 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 200 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired. The voltage to be imparted to annular electrodes 27 of control electrode 26 to prevent passage of toner 21 should not be particularly limited. In the above embodiment, control electrode 26 has a single drive configuration in which control of jumping of toner through each gate 29 is performed by a different electrode, but the present invention can be also applied to a matrix drive configuration using matrix control. The image forming apparatus in accordance with the invention can also be applied to the printing unit in digital copiers and facsimile machines as well as to digital printers, plotters, etc.

Up to now, the processing operation of the image forming apparatus shown in FIG. 4 has been discussed.

Next, the evaluation result of the images produced in the monochrome image forming apparatus using the different developers will be explained. In this case, the setup voltage was varied in order to produce images by changing the electric field strength.

First, under the assumption that the electric field generated by the potential of annular electrodes 27 of control electrode 26 would be not less than the electric field produced by the potential of opposing electrode 25, the density of dots formed by the electric field strength which was determined by the voltage to annular electrodes 27 of control electrode 26 was checked.

The images to be evaluated were formed, with the distance between toner support 22 and annular electrodes 27 of control electrode 26 set at 100 μm, the distance between toner support 22 and opposing electrode 25 fixed at 1 mm, the toner support 22 grounded, the voltage of the opposing electrode 25 set from 0.5 kV to 3 kV, annular electrodes 27 of control electrode 26 varied from 50 V to 300 V.

Five samples of toners (No.3, 4, 16, 21 and 22) shown in the first embodiment were used. The measurement of dot density for image evaluation was performed by an image analyzer (SPECTRUM 2, a product of MITANI Corporation).

Since a dot density of 0.7 or more was required for a good print for this measurement, the voltages of opposing electrode 26 and annular electrodes 27 of control electrode 26 were varied and determined so as to allow each toner to provide a dot density of 0.7 or higher, and the thus determined voltages were used to find the values of the electric field.

Sample No.3 (bulk density 0.370 g/cc) 0.85 kV/mm

Sample No.4 (bulk density 0.397 g/cc) 1.05 kV/mm

Sample No.16 (bulk density 0.370 g/cc) 0.81 kV/mm

Sample No.21 (bulk density 0.417 g/cc) 0.95 kV/mm

Sample No.22 (bulk density 0.370 g/cc) 1.35 kV/mm

From these results, it was found that the required density of dots can be obtained, which will probably produce good images, when the bulk density of a toner and the required electric field strength satisfy the following relationship:

$$\Delta V1/d1=E>2.5-4\times AD$$

where ΔV1 represents the potential difference between the control electrode and the developer support, dl the distance between the control electrode and the developer support, El the electric field strength (kV/mm), and AD the bulk density ($g/cm^3$).

From these results, the electric field strength of this embodiment is lower than that for the bulk densities of the toners shown in the first embodiment. The reason is as follows. That is, in this embodiment, annular electrodes 27 of control electrode 26 and opposing electrode 25 are used for causing the toner to jump, and annular electrodes 27 of control electrode 26 are disposed close to the toner. Accordingly, the toner is caused to jump from an area S2 on the sleeve, which is greater than the area of one annular electrode 27, and the toner which has left that area is made to converge through the passage of annular electrode 27 to form a dot. Therefore, the amount of the toner that jumps from the sleeve can be reduced to obtain the same density of dots, compared to that of the first embodiment.

In the above description of the embodiments, a monochrome image forming apparatus was illustrated. The present invention can also be applied to a color image forming apparatus.

Figure 8:
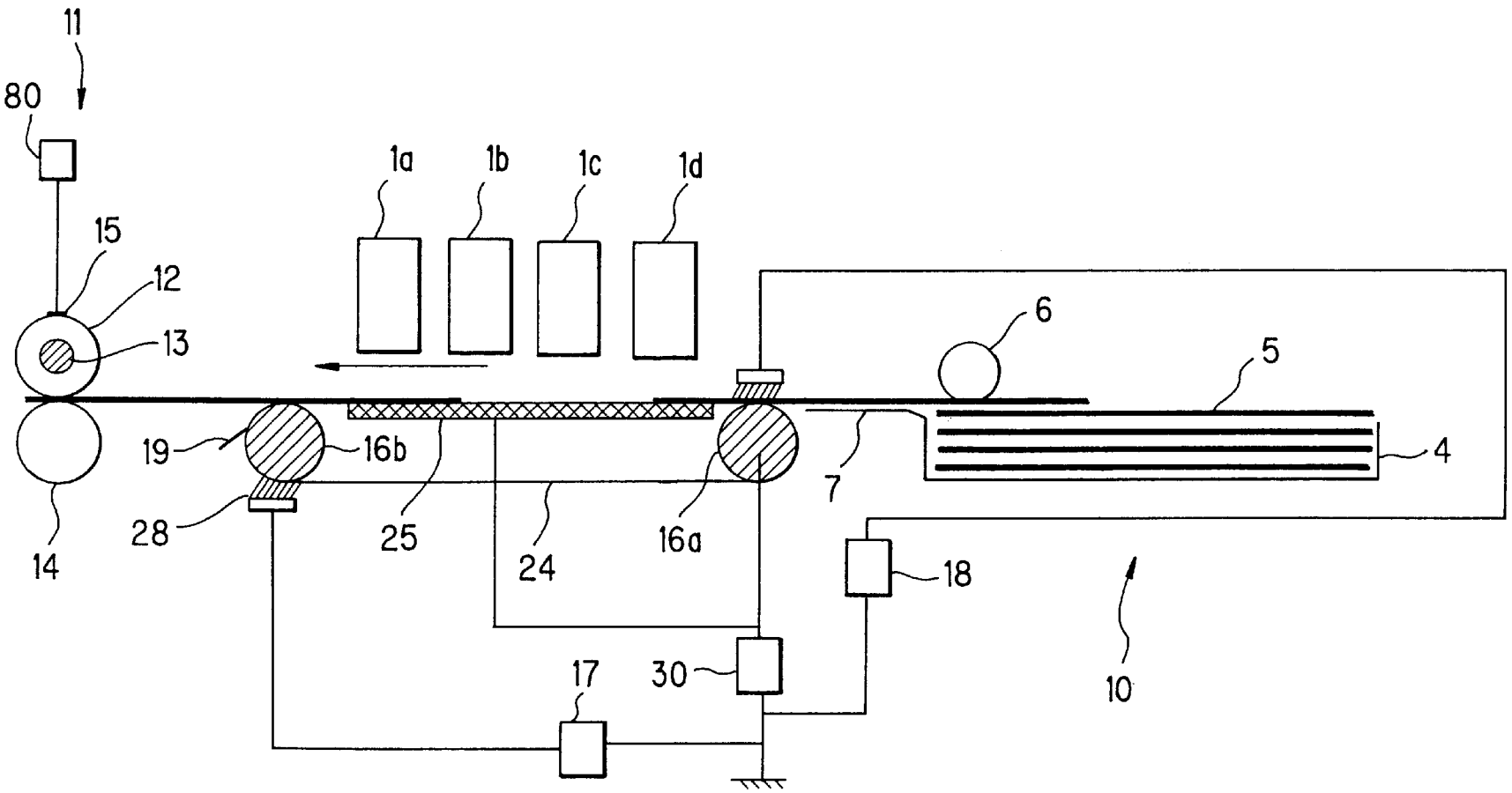
FIG. 8 is a diagram showing the configuration of a color image forming apparatus to which the present invention is applied.

Now, description will be made of a case where the present invention is applied to a color image forming apparatus. FIG. 8 is a diagram showing the configuration of a color image forming apparatus to which the present invention is applied.

As shown in this figure, the color image forming apparatus is configured by providing a plurality of image forming units 1*a*, 1*b*, 1*c* and 1*d* made up of toner supplying sections 2*a*, 2*b*, 2*c* and 2*d* and printing sections 3*a*, 3*b*, 3*c* and 3*d* wherein toner supplying sections 2*a*, 2*b*, 2*c* and 2*d* corresponds to yellow, magenta, cyan and black. The other components are the same as those shown in FIG. 2.

In the present invention, since the electric field strength can be adjusted adaptively depending upon the bulk density of the color toners, it is possible to achieve a desired reproduction of color and hence produce a good color image.

In the description of the modes of the above first and second embodiments, the present invention was applied to a printer having a configuration for negatively charged toner, but the invention will not be limited to this and can be applied to an image forming apparatus having a configuration for positively charged toner.

As has been detailed heretofore, in the first configuration of the invention, when ΔV represents the potential difference between the supporting member and opposing electrode and E represents the electric field strength, an arbitrary developer having a bulk density AD is used wherein the bulk density AD and the potential difference ΔV satisfy the following relation:

$$\Delta V/d=E>5.5-10\times AD.$$

As a result, it is possible to perform a good image forming operation regardless of the bulk density of the developer, by adjusting the electric field strength.

In accordance with the second configuration, a developer having a bulk density AD which satisfies the following relation is used:

$$E0>2.5-4\times AD$$

where E0 is the electric field strength acting on the developer on the supporting member and determined by the combination of the electric field strength based on the potential difference and distance between the opposing electrode and the supporting member and the electric field strength based on the potential difference and distance between the control electrode and supporting member. As a result, it is possible to perform a good image forming operation regardless of the bulk density of the developer, by properly adjusting the electric field strengths at the control electrode and the opposing electrode.

In the third configuration of the invention, the supplying means comprises a plurality of supporting member which support different colors of developers. As a result, it is possible to perform a good image forming operation with a faithful reproduction of colors regardless of the bulk density of the developer, by adjusting the electric field strengths at the control electrode and the opposing electrode, taking into consideration the degrees of influence from these two electrodes.

What is claimed is:

1. An image forming apparatus comprising:

a supporting member at least supporting a color of developer; and an opposing member disposed facing the supporting member, wherein d>>dt, where dt(mm) is the developer layer thickness and d(mm) is the gap between the opposing member and the supporting member, the image forming apparatus being characterized in that an arbitrary developer having a bulk density AD(g/cc) is used wherein the bulk density AD and the potential difference Δ V between the supporting member and opposing member satisfy the following relation:

$$\Delta V/d=E>5.5-10\times AD,$$

where the electric field strength represents E(KV/mm).

2. The image forming apparatus of claim 1 wherein the bulk density AD is equal to or greater than 0.35 g/cc and equal to or lower than 0.50 g/cc.

3. An image forming apparatus comprising:

a supplying means having a supporting member which supports at least a color of developer;

an opposing electrode disposed facing the supporting member; and a control electrode having a plurality of passage holes with electrodes for providing the jumping passage of the developer transferring from the supporting member and disposed between the opposing electrode and supporting member, wherein an image is formed on a recording medium which is conveyed between the control electrode and opposing electrode whilst the voltage to be applied to the control electrode is controlled in accordance with image data, characterized in that an arbitrary developer having a bulk density AD (g/cc) which satisfies the following relation is used:

$$E0>2.5-4\times AD$$

where E0 (KV/mm) is the electric field strength determined by the combination of the electric field strength based on the potential difference and distance between the opposing electrode and the supporting member and the electric field strength based on the potential difference and distance between the control electrode and supporting member.

4. The image forming apparatus according to claim 3, wherein the supplying means comprises a plurality of supporting members which supports different colors of developers.

5. The image forming apparatus of claim 3 wherein the bulk density AD is equal to or greater than 0.35 g/cc and equal to or lower than 0.50 g/cc.

6. A method for forming an image in an image forming apparatus comprising a supporting member at least supporting a color developer, and an opposing member disposed facing the supporting member wherein d>>dt, where dt (mm) is the developer layer thickness and d (mm) is the gap between the opposing member and the supporting member, the method comprising the steps of:

providing a developer having a bulk density AD (g/cc);

providing a potential difference ΔV between the supporting member and the opposing member satisfying the following relation:

$$\Delta V/d=E>5.5-10\times AD$$

where E represents the electric field strength (V/mm).

7. The method of claim 6, wherein the bulk density AD is equal to or greater than 0.35 g/cc and equal to or lower than 0.50 g/cc.

8. A method for forming an image in an image forming apparatus comprising a supporting member at least supporting a color developer, an opposing member disposed facing the supporting member, and a control electrode having a plurality of passage holes with electrodes for for providing jumping passage of a developer transferring from the supporting member and disposed between the opposing electrode and supporting member, wherein an image is formed on a recording medium that is conveyed between the control electrode and the opposing electrode while the voltage to be applied to the control electrode in accord with image data, the method comprising the steps of:

providing a developer having a bulk density AD (g/ cc) that satisfies the following relation:

$$E0>2.5-4\times AD$$

where E0 (v/mm) is the electric field strength determined by the combination of the electric field strength based on the potential difference and distance between the opposing electrode and the supporting member and the electric field strength based on the potential difference and distance between the control electrode and the supporting member.

9. The method of claim 8, wherein the bulk density AD is equal to or greater than 0.35 g/cc and equal to or lower than 0.50 g/cc.

* * * * *